US009384688B2

(12) United States Patent
Kim et al.

(10) Patent No.: US 9,384,688 B2
(45) Date of Patent: Jul. 5, 2016

(54) LCD PIXEL CIRCUIT FOR SUPPRESSING THE MIXTURE OF COLORS DUE TO DIFFERENCES IN DATA SIGNAL TRANSFER TIMES

(71) Applicant: RAONTECH INC., Gyeonggi-do (KR)

(72) Inventors: Min-Seok Kim, Yongin-si (KR); Jang-Sub Sohn, Seoul (KR)

(73) Assignee: RAONTECH INC., Gyeonggi-Do (KR)

( * ) Notice: Subject to any disclaimer, the term of this patent is extended or adjusted under 35 U.S.C. 154(b) by 44 days.

(21) Appl. No.: 14/325,596

(22) Filed: Jul. 8, 2014

(65) Prior Publication Data

US 2015/0325162 A1 Nov. 12, 2015

(30) Foreign Application Priority Data

May 8, 2014 (KR) ..... 10-2014-0054681

(51) Int. Cl.
*G09G 3/36* (2006.01)
*G09G 3/20* (2006.01)

(52) U.S. Cl.
CPC ..... *G09G 3/2003* (2013.01); *G09G 3/3611* (2013.01); *G09G 3/3659* (2013.01); *G09G 3/3696* (2013.01); *G09G 2300/0823* (2013.01); *G09G 2300/0842* (2013.01); *G09G 2320/0233* (2013.01); *G09G 2320/0242* (2013.01)

(58) Field of Classification Search
CPC ..... G09G 3/3614; G09G 3/3659; G09G 2300/0823; G09G 2300/842; G09G 3/3688; G09G 2320/0247; G09G 2300/0809
See application file for complete search history.

(56) References Cited

U.S. PATENT DOCUMENTS 5,235,253 A * 8/1993 Sato ..... G09G 3/30 315/169.3
5,581,273 A * 12/1996 Yoneda ..... G09G 3/3648 345/90
5,959,599 A * 9/1999 Hirakata ..... G09G 3/3659 345/92
6,456,267 B1 * 9/2002 Sato ..... G09G 3/3659 345/204
2002/0024511 A1 * 2/2002 Ozawa ..... G09G 3/2011 345/204
2009/0267885 A1 * 10/2009 Yen ..... G09G 3/3614 345/98
2015/0277177 A1 * 10/2015 Lin ..... G02F 1/13624 345/209

FOREIGN PATENT DOCUMENTS

KR 1020070118457 12/2007

* cited by examiner

*Primary Examiner* — Chanh Nguyen
*Assistant Examiner* — Navin Lingaraju

(57) ABSTRACT

A circuit for driving a liquid crystal display includes: a high selection unit turned on by a high selection signal and transferring a high data signal or a common voltage to one side of a storage capacitor; a low selection unit; a high transfer unit connected to one side of the storage capacitor; and a low transfer unit connected to the other side of the storage capacitor, turned on by a low transfer signal and transferring voltage stored at the other side of the storage capacitor to one side of the liquid crystal capacitor or transferring the low data signal or the common voltage transferred by the low selection unit to one side of the liquid crystal capacitor.

4 Claims, 4 Drawing Sheets

LCD PIXEL CIRCUIT FOR SUPPRESSING THE MIXTURE OF COLORS DUE TO DIFFERENCES IN DATA SIGNAL TRANSFER TIMES

BACKGROUND OF THE INVENTION

1. Field of the Invention

The present invention relates to a circuit for driving a liquid crystal display, and more specifically, to a circuit for driving a liquid crystal display, which can effectively suppress degrade of brightness or mixture of colors caused by a difference between the transfer time of a data signal selected first and the transfer time of a data signal selected later.

2. Background of the Related Art

Recently, a field sequential color driving method has been proposed as a method of driving backlight to obtain a further better screen quality using a backlight unit configured of light emitting diodes (LEDs).

In displaying a color, such a field sequential color driving method does not use RGB color filters and displays the color using an afterimage effect generated in the eyes of a person by sequentially driving RGB light sources.

However, a field sequential color liquid crystal display has a problem in that displayed brightness is degraded or colors are mixed due to a difference between the transfer time of a data signal selected first and the transfer time of a data signal selected later.

Korean Laid-Open Patent No. 10-2007-0118457 has been disclosed on Dec. 17, 2007 as a background technique of the present invention.

SUMMARY OF THE INVENTION

Therefore, the present invention has been made in view of the above problem, and it is an object of the present invention to provide a circuit for driving a liquid crystal display, which can effectively suppress degrade of brightness or mixture of colors caused by a difference between the transfer time of a data signal selected first and the transfer time of a data signal selected later.

A circuit for driving a liquid crystal display according to an embodiment of the present invention includes a high selection unit turned on by a high selection signal and transferring a high data signal or a common voltage to one side of a storage capacitor; a low selection unit turned on by a low selection signal and transferring a low data signal or the common voltage to the other side of the storage capacitor; a high transfer unit connected to one side of the storage capacitor, turned on by a high transfer signal and transferring voltage stored at one side of the storage capacitor to one side of a liquid crystal capacitor or transferring the high data signal or the common voltage transferred by the high selection unit to one side of the liquid crystal capacitor; and a low transfer unit connected to the other side of the storage capacitor, turned on by a low transfer signal and transferring voltage stored at the other side of the storage capacitor to one side of the liquid crystal capacitor or transferring the low data signal or the common voltage transferred by the low selection unit to one side of the liquid crystal capacitor.

In the circuit for driving a liquid crystal display according to an embodiment of the present invention, the high selection unit and the high transfer unit may be p-MOS transistors, and the low selection unit and the low transfer unit may be n-MOS transistors.

In the circuit for driving a liquid crystal display according to an embodiment of the present invention, while the high selection unit and the high transfer unit are turned off and the low selection unit and the low transfer unit are turned on, the low transfer unit may transfer the common voltage transferred by the low selection unit to one side of the liquid crystal capacitor.

In the circuit for driving a liquid crystal display according to an embodiment of the present invention, while the high selection unit and the low transfer unit are turned off and the low selection unit and the high transfer unit are turned on thereafter, the high transfer unit may transfer the voltage stored at one side of the storage capacitor to one side of the liquid crystal capacitor.

In the circuit for driving a liquid crystal display according to an embodiment of the present invention, while the high transfer unit and the low transfer unit are turned off and the high selection unit and the low selection unit are turned on thereafter, the high selection unit may transfer the common voltage to one side of the storage capacitor, and the low selection unit may transfer the low data signal to the other side of the storage capacitor.

In the circuit for driving a liquid crystal display according to an embodiment of the present invention, while the low selection unit and the low transfer unit are turned off and the high selection unit and the high transfer unit are turned on thereafter, the low transfer unit may transfer the common voltage transferred by the high selection unit to one side of the liquid crystal capacitor.

In the circuit for driving a liquid crystal display according to an embodiment of the present invention, while the low selection unit and the high transfer unit are turned off and the high selection unit and the low transfer unit are turned on thereafter, the low transfer unit may transfer the voltage stored at the other side of the storage capacitor to one side of the liquid crystal capacitor.

In the circuit for driving a liquid crystal display according to an embodiment of the present invention, while the high transfer unit and the low transfer unit are turned off and the high selection unit and the low selection unit are turned on thereafter, the high selection unit may transfer the high data signal to one side of the storage capacitor, and the low selection unit may transfer the common voltage to the other side of the storage capacitor.

DESCRIPTION OF SYMBOLS

Figure 1:
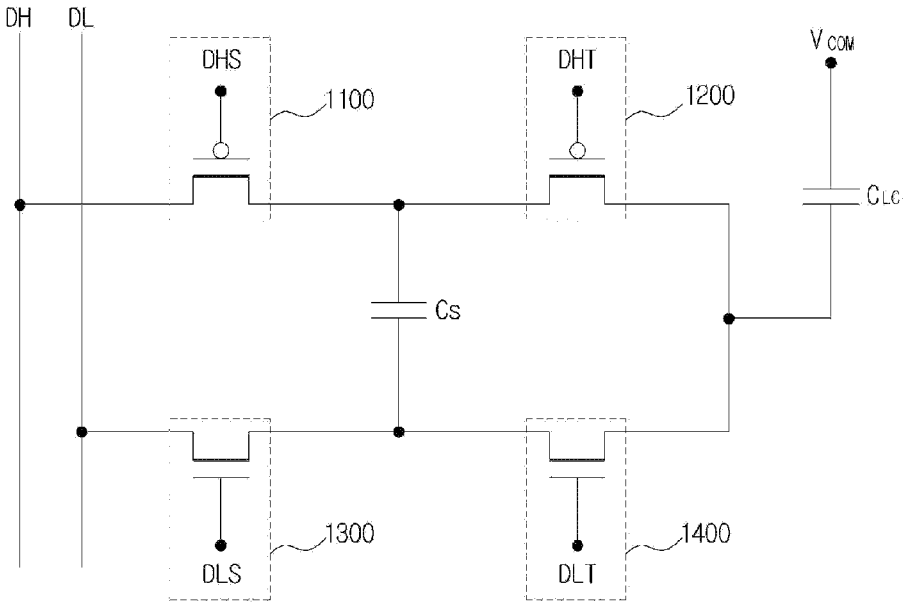
FIG. 1 is a view showing a circuit for driving a liquid crystal display according to embodiments of the present invention.

| | |
|---|---|
| 1100: High selection unit | 1300: Low selection unit |
| 1200: High transfer unit | 1400: Low transfer unit |
| DHS: High selection signal | DH: High data line |
| VDH: High data signal | DHT: High transfer signal |
| DLS: Low selection signal | DL: Low data line |
| VDL: Low data signal | CS: Storage capacitor |
| CLC: Liquid crystal capacitor | VCOM: Common voltage |

DETAILED DESCRIPTION OF THE PREFERRED EMBODIMENT

Details of other embodiments are included in the detailed descriptions and drawings.

Advantages and features of the present invention, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims. Like reference numerals refer to like elements throughout.

As shown in FIG. 1, a circuit for driving a liquid crystal display according to an embodiment of the present invention is configured to include a high selection unit 1100, a low selection unit 1300, a high transfer unit 1200 and a low transfer unit 1400.

Here, the high selection unit 1100 is turned on by a high selection signal DHS and transfers a high data signal VDH applied to a high data line DH or a common voltage VCOM to one side of a storage capacitor CS, and the low selection unit 1300 is turned on by a low selection signal DLS and transfers a low data signal VDL applied to a low data line DL or the common voltage VCOM to one side of the storage capacitor CS.

Meanwhile, the high transfer unit 1200 is connected to one side of the storage capacitor CS, is turned on by a high transfer signal DHT and transfers voltage stored at one side of the storage capacitor CS to one side of a liquid crystal capacitor CLC or transfers the high data signal VDH or the common voltage VCOM transferred by the high selection unit 1100 to one side of the liquid crystal capacitor CLC, and the low transfer unit 1400 is connected to the other side of the storage capacitor CS, is turned on by a low transfer signal DLT and transfers the voltage stored at the other side of the storage capacitor CS to one side of the liquid crystal capacitor CLC or transfers the low data signal VDL or the common voltage VCOM transferred by the low selection unit 1300 to one side of the liquid crystal capacitor CLC. Here, the common voltage VCOM is applied to the other side of the liquid crystal capacitor CLC.

Specifically, the high selection unit 1100 and the high transfer unit 1200 may be configured of a p-MOS transistor, and the low selection unit 1300 and the low transfer unit 1400 may be configured of an n-MOS transistor.

Hereinafter, operation of the circuit for driving a liquid crystal display according to an embodiment of the present invention will be described in detail with reference to FIGS. 2 to 7.

Figure 2:
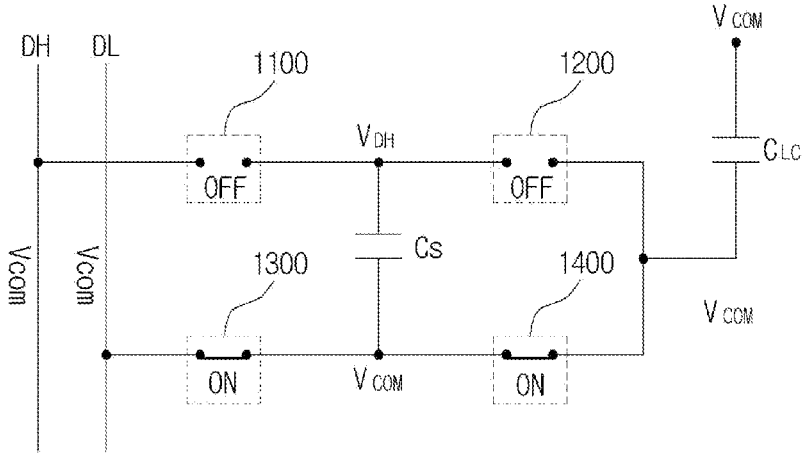
FIGS. 2 to 7 are views showing voltages transferred at each step in a circuit for driving a liquid crystal display according to embodiments of the present invention.

First, as shown in FIG. 2, while the high selection unit 1100 and the high transfer unit 1200 are turned off and the low selection unit 1300 and the low transfer unit 1400 are turned on, the low selection unit 1300 transfers a common voltage VCOM to one side of the storage capacitor CS, and the low transfer unit 1400 transfers the common voltage VCOM transferred by the low selection unit 1300 to one side of the liquid crystal capacitor CLC. Here, it is assumed that voltage of a high data signal VDH is stored at one side of the storage capacitor CS. As a result, the liquid crystal capacitor CLC is initialized to the common voltage VCOM.

Figure 3:
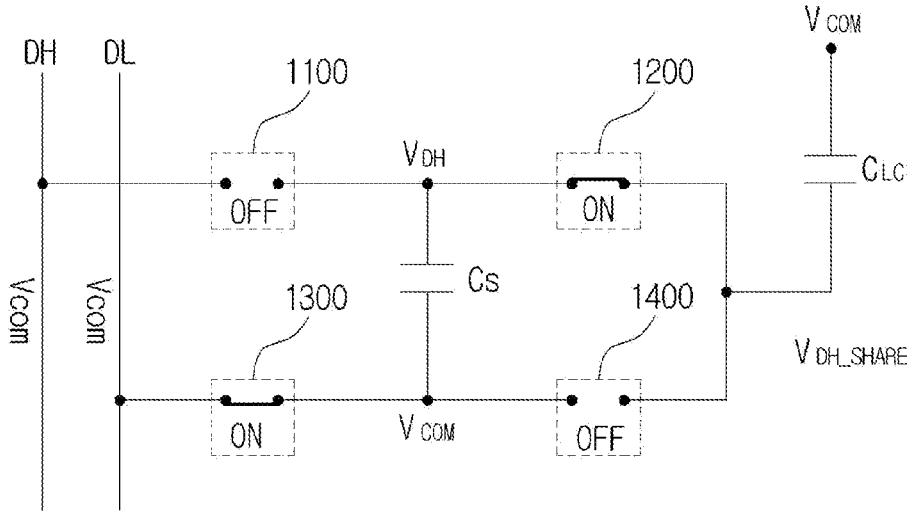

Next, as shown in FIG. 3, while the high selection unit 1100 and the low transfer unit 1400 are turned off and the low selection unit 1300 and the high transfer unit 1200 are turned on, the low selection unit 1300 transfers the common voltage VCOM to one side of the storage capacitor CS, and the high transfer unit 1200 transfers the voltage stored at one side of the storage capacitor CS to one side of the liquid crystal capacitor CLC. As a result, since the voltage of the high data signal VDH stored at one side of the storage capacitor CS is distributed to one side of the liquid crystal capacitor CLC, the same voltage VDH_SHARE is maintained at one side of the storage capacitor CS and one side of the liquid crystal capacitor CLC, and magnitude of the voltage VDH_SHARE is determined by a ratio of capacitance of the liquid crystal capacitor CLC and capacitance of the storage capacitor CS.

Figure 4:
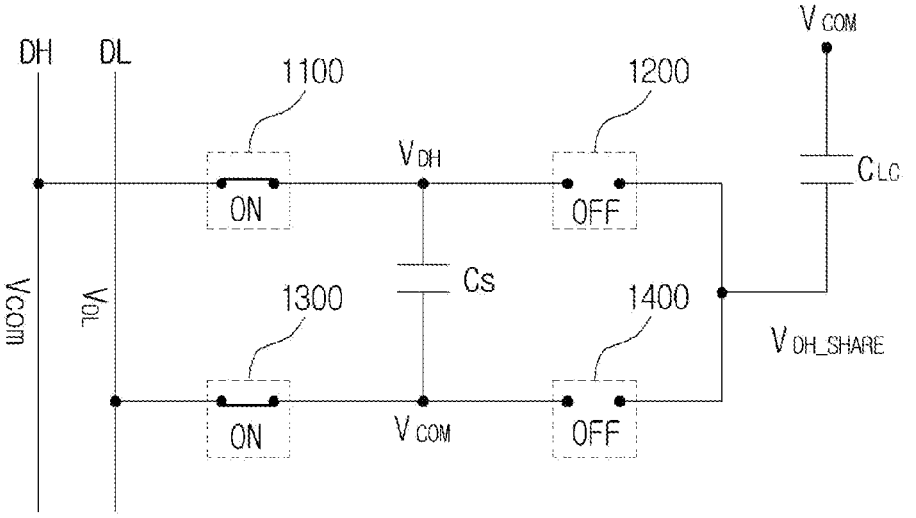

Next, as shown in FIG. 4, while the high transfer unit 1200 and the low transfer unit 1400 are turned off and the high selection unit 1100 and the low selection unit 1300 are turned on, the high selection unit 1100 transfers the common voltage VCOM to one side of the storage capacitor CS, and the low selection unit 1300 transfers the low data signal VDL to the other side of the storage capacitor CS. As a result, the common voltage VCOM is stored at one side of the storage capacitor CS, voltage of the low data signal VDL is stored at the other side of the storage capacitor CS, and the distributed voltage of the high data signal VDH_SHARE is maintained at one side of the liquid crystal capacitor CLC.

Figure 5:
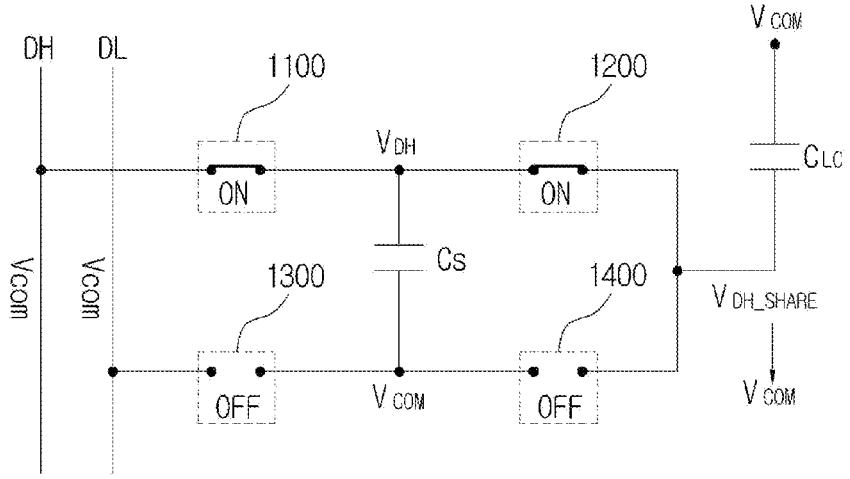

Next, as shown in FIG. 5, while the low selection unit 1300 and the low transfer unit 1400 are turned off and the high selection unit 1100 and the high transfer unit 1200 are turned on, the low transfer unit 1400 transfers the common voltage VCOM transferred by the high selection unit 1100 to one side of the liquid crystal capacitor CLC. As a result, the common voltage VCOM is stored at one side of the liquid crystal capacitor CLC and at one side of the storage capacitor CS, and the voltage of the low data signal VDL is maintained at the other side of the storage capacitor CS.

Figure 6:
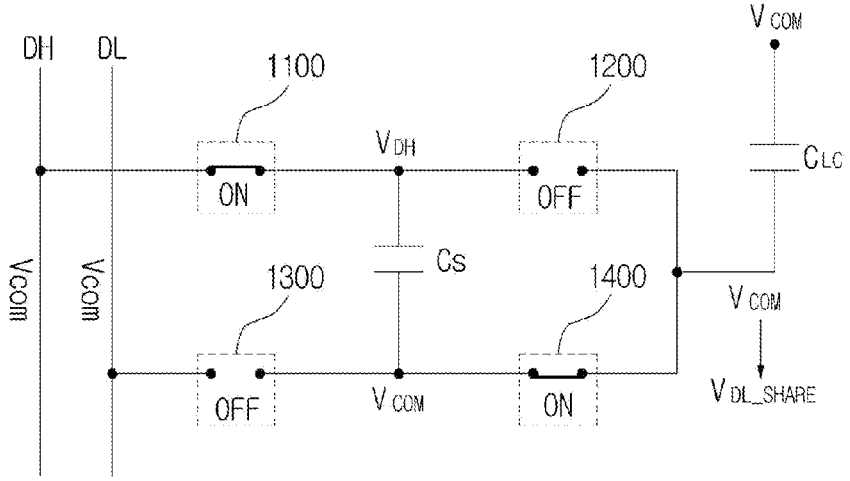

Next, as shown in FIG. 6, while the low selection unit 1300 and the high transfer unit 1200 are turned off and the high selection unit 1100 and the low transfer unit 1400 are turned on, the high transfer unit 1200 transfers the common voltage VCOM to one side of the storage capacitor CS, and the low transfer unit 1400 transfers the voltage stored at the other side of the storage capacitor CS to one side of the liquid crystal capacitor CLC. As a result, since the voltage of the low data signal VDL stored at the other side of the storage capacitor CS is distributed to one side of the liquid crystal capacitor CLC, the same voltage VDL_SHARE is maintained at the other side of the storage capacitor CS and at one side of the liquid crystal capacitor CLC, and magnitude of the voltage VDH_SHARE is determined by a ratio of capacitance of the liquid crystal capacitor CLC and capacitance of the storage capacitor CS.

Figure 7:
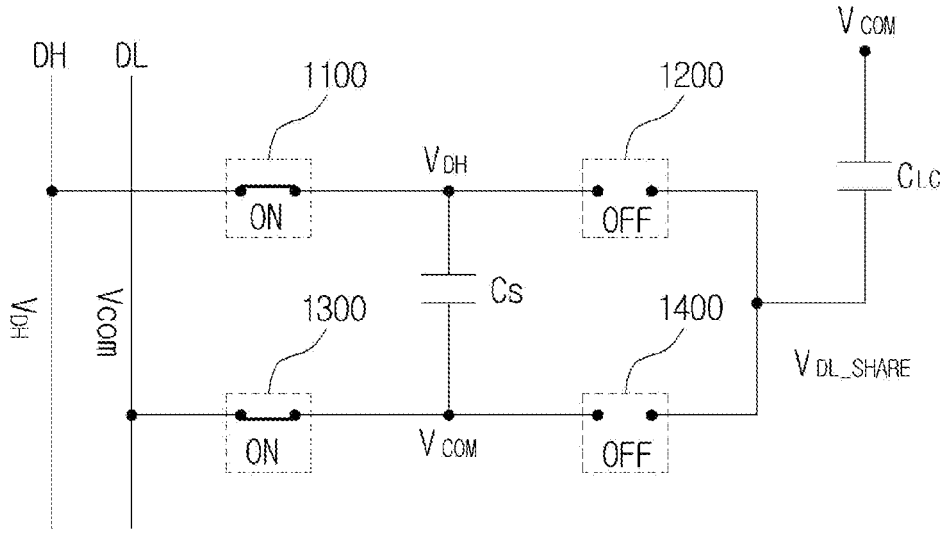

Next, as shown in FIG. 7, while the high transfer unit 1200 and the low transfer unit 1400 are turned off and the high selection unit 1100 and the low selection unit 1300 are turned on, the high selection unit 1100 transfers the high data signal VDH to one side of the storage capacitor CS, and the low selection unit 1300 transfers the common voltage VCOM to the other side of the storage capacitor CS. As a result, the common voltage VCOM is stored at the other side of the storage capacitor CS, the voltage of the high data signal VDH is stored at one side of the storage capacitor CS, and the distributed voltage of the low data signal VDL_SHARE is maintained at one side of the liquid crystal capacitor CLC.

Meanwhile, the circuit for driving a liquid crystal display according to an embodiment of the present invention sequentially and repeatedly performs the six steps described above.

Accordingly, the circuit for driving a liquid crystal display according to an embodiment of the present invention may effectively suppress degrade of brightness or mixture of colors caused by a difference between the transfer time of a data signal selected first and the transfer time of a data signal selected later by transferring a high data signal VDH or a low data signal VDL to the liquid crystal capacitor CLC through the storage capacitor CS after initializing the liquid crystal capacitor CLC to the common voltage VCOM.

The circuit for driving a liquid crystal display according to embodiments of the present invention may effectively suppress degrade of brightness or mixture of colors caused by a difference between the transfer time of a data signal selected first and the transfer time of a data signal selected later by transferring an updated data signal to the liquid crystal capacitor after initializing the data signal stored in the liquid crystal capacitor and updating storage capacitors with a new data signal.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A circuit for driving a liquid crystal display, the circuit comprising:

a first p-MOS transistor turned on by a high selection signal and transferring a high data signal or a common voltage to one side of a storage capacitor;

a first n-MOS transistor turned on by a low selection signal and transferring a low data signal or the common voltage to the other side of the storage capacitor;

a second p-MOS transistor connected to one side of the storage capacitor, turned on by a high transfer signal and transferring voltage stored at one side of the storage capacitor to one side of a liquid crystal capacitor or transferring the high data signal or the common voltage transferred by the first p-MOS transistor to one side of the liquid crystal capacitor; and a second n-MOS transistor connected to the other side of the storage capacitor, turned on by a low transfer signal and transferring voltage stored at the other side of the storage capacitor to one side of the liquid crystal capacitor or transferring the low data signal or the common voltage transferred by the first n-MOS transistor to one side of the liquid crystal capacitor, wherein while first p-MOS transistor and the second p-MOS transistor are turned off and the first n-MOS transistor and the second n-MOS transistor are turned on, the second n-MOS transistor transfers the common voltage transferred by the first n-MOS transistor to one side of the liquid crystal capacitor, wherein while the first p-MOS transistor and the second n-MOS transistor are turned off and the first n-MOS transistor and the second p-MOS transistor are turned on thereafter, the second p-MOS transistor transfers the voltage stored at one side of the storage capacitor to one side of the liquid crystal capacitor, and wherein while the second p-MOS transistor and the second n-MOS transistor are turned off and the first p-MOS transistor and the first n-MOS transistor are turned on thereafter, the first p-MOS transistor transfers the common voltage to one side of the storage capacitor, and the first n-MOS transistor transfers the low data signal to the other side of the storage capacitor.

2. The circuit according to claim 1, wherein while the first n-MOS transistor and the second n-MOS transistor are turned off and the first p-MOS transistor and the second p-MOS transistor are turned on thereafter, the second n-MOS transistor transfers the common voltage transferred by the first p-MOS transistor to one side of the liquid crystal capacitor.

3. The circuit according to claim 2, wherein while the first n-MOS transistor and the second p-MOS transistor are turned off and the first p-MOS transistor and the second n-MOS transistor are turned on thereafter, the second n-MOS transistor transfers the voltage stored at the other side of the storage capacitor to one side of the liquid crystal capacitor.

4. The circuit according to claim 3, wherein while the second p-MOS transistor and the second n-MOS transistor are turned off and the first p-MOS transistor and the first n-MOS transistor are turned on thereafter, the first p-MOS transistor transfers the high data signal to one side of the storage capacitor, and the first n-MOS transistor transfers the common voltage to the other side of the storage capacitor.

* * * * *